United States Patent [19]

Woo

[11] 4,000,537

[45] Jan. 4, 1977

[54] PAINT ROLLER DEVICE HAVING JUXTA-POSED ROLLERS

[76] Inventor: Yen Kong Woo, 1545 Geary St. Apt. No. 1, San Francisco, Calif. 94115

[22] Filed: Oct. 23, 1975

[21] Appl. No.: 625,310

[52] U.S. Cl. ..... 15/230.11; 15/143 B

[51] Int. Cl.[2] ..... B05C 17/02; B25G 1/04

[58] Field of Search ..... 15/27, 230.11; 29/110.5; 34/95.3; 101/328–330; 128/57; 401/21, 197, 208, 219, 220

[56] References Cited

UNITED STATES PATENTS

| | | | |
|---|---|---|---|
| 342,781 | 6/1886 | Cook | 34/95.3 |
| 2,160,149 | 5/1939 | Jellinek | 15/27 |
| 2,187,585 | 1/1940 | Grigas | 15/230.11 X |
| 2,589,407 | 3/1952 | Lee | 401/218 |
| 2,805,436 | 9/1957 | Christensen et al. | 101/329 |
| 3,085,270 | 4/1963 | Vosbikian et al. | 15/230.11 X |
| 3,130,435 | 4/1964 | Smith | 15/230.11 |
| 3,409,929 | 11/1968 | Fisher | 15/230.11 X |

FOREIGN PATENTS OR APPLICATIONS

| | | | |
|---|---|---|---|
| 149,345 | 4/1937 | Austria | 101/329 |
| 1,579,501 | 7/1969 | France | 15/230.11 |
| 1,133,801 | 11/1956 | France | 15/230.11 |
| 1,525,341 | 4/1968 | France | 15/230.11 |
| 1,010,288 | 11/1965 | United Kingdom | 15/230.11 |

*Primary Examiner*—Daniel Blum

[57] ABSTRACT

A pair of juxta-posed rotatably mounted adjustable width rollers including a lead roller and a drip-catching follower roller to the axles of which a handle is pivotally attached for actuating the pair of rollers from a multiplicity of handle positions to apply the paint therewith to a surface.

4 Claims, 9 Drawing Figures

PAINT ROLLER DEVICE HAVING JUXTA-POSED ROLLERS

During recent years considerable attention has been directed to the provision of a number of differently constructed and differently mounted paint rollers all devised for improving the efficiency of paint application to flat surfaces in a minimum of time and a minimum of effort thereby to accomplish any given job of painting in an inexpensive way. For the most part, prior paint rollers comprise a single applicator roller which is recurrently dipped into a quantity of paint disposed in a pan to pick up a portion of the available paint in a desired amount for application without undue dripping to flat surfaces. The present invention is directed to the provision of a further improvement in the art of paint applicators which combines for the first time rotatably mounted rollers arranged in tandem to effect the dual purpose of efficaceously picking up of the paint recurrently in effective amounts by one roller of the tandem and of catching any dripped paint on the other roller of the tandem while evenly spreading the paint over various surfaces with the tandem of rollers as well as with but one roller.

A primary object of the present invention is to provide a drip-proof paint roller device which enables the application of paint with a lead roller and a drip-catching follower roller in simultaneous rolling engagement with a paint-receiving surface.

Another important object of my invention is to provide a drip-proof paint roller device of the indicated nature which is additionally characterized by a construction which enables dual application of a lead roller and a drip-catching follower roller throughout approximately 180° of movement of an actuator handle to maintain rolling engagement of the lead roller as well as the follower roller with a paint-receiving surface and provide a smoother, more uniform layer of paint thereon.

A still further object of the invention is to provide a drip-proof roller device of the aforementioned character which is readily and facilely converted to short widths and longer widths of the lead and follower rollers.

Another object of the present invention is to provide an inexpensively manufactured drip-proof roller device of the aforesaid nature which can be assembled and utilized with one of the rollers held in an underlying position relative to the other surface-engaging roller to accomodate for paint application to surfaces above the operator.

Other objects of the invention, together with some of the advantageous features thereof, will appear from the following description of an embodiment thereof which is illustrated in the accompanying drawings and which is an exemplification of the best mode of construction and manner of using the invention.

Referring to the drawings.

Figures 1, 2, 3, 4, 5, 6, 7, 8, 9:
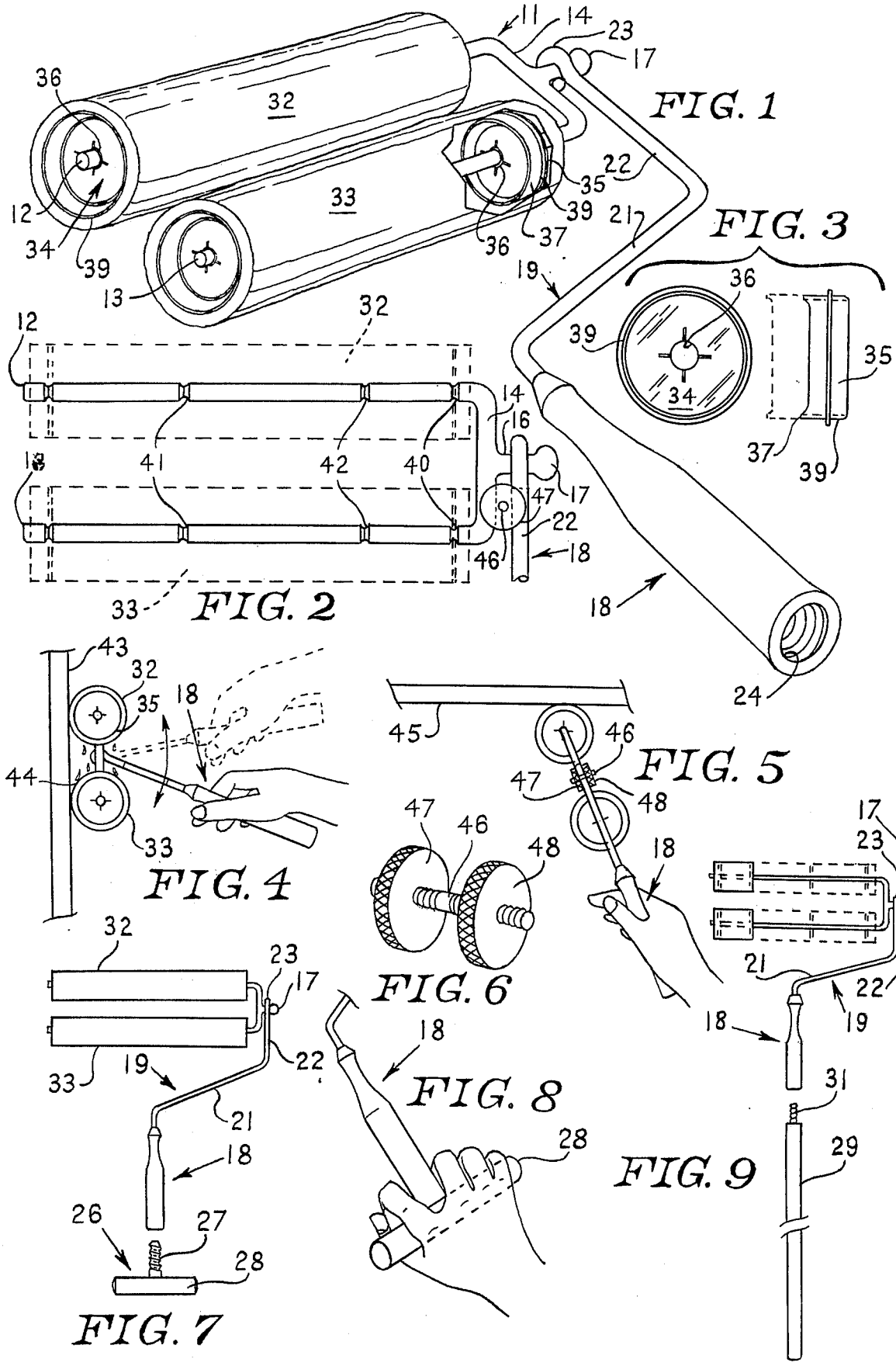
FIG. 1 is an enlarged perspective view of an embodiment of the invention, parts being broken away to illustrate the mounting and assembly of an end support and closure component employed therein.
FIG. 2 is a plan view of the notched juxta-posed axles in an axle frame; this view showing the rollers in dotted lines arranged on the two axles and also showing a broken elevational view of the pivotally mounted actuator handle, and shows a plan view of a latching means for locking the handle in the plane of the axle frame.
FIG. 3 is an exploded view of an end support and closure component used in the embodiment of the invention shown in FIG. 1; the exploded view of FIG. 1 illustrating the component in front and side elevations.
FIG. 4 is a fragmentary detail illustrating the engagement of both rollers with a vertically disposed surface and also illustrating paint drops dripping from the lead roller onto the follower roller and the handle held in a plane normal to the paint-receiving surface.

FIG. 5 is a reduced perspective view of the embodiment of my invention shown in FIGS. 1 and 2; this view illustrating the lead roller in engagement with an overhead surface and the follower roller in a drip-catching underlying position relative to the lead roller, and also showing the latching means in operative position for maintaining the follower roller out of engagement with the overhead surface.

FIG. 6 is an enlarged perspective view of a lock component utilized with my preferred embodiment, as shown in FIG. 5.

FIG. 7 is a broken reduced elevational view of the preferred embodiment of the invention with handle grip attachment.

FIG. 8 is a fragmentary perspective view illustrating the manner of using the invention with handle grip attachment assembled thereon.

FIG. 9 is an exploded view of the embodiment of my invention in reduced showing and with rollers in dotted lines but with a handle extension for using the invention at heights not reached with the short handle of FIG. 1.

In its best mode of construction, the drip-proof paint roller device of my invention comprises an axle frame defining a pair of juxta-posed parallel arranged axles, a paint roller mounted for rotation on each of said axles, removable and adjustable end support and closure members on each of said rollers, together with latching means on said axles for maintaining said end supporting and closure members at any one of a plurality of aligned locations on said axles to convert the rollers into shorter and longer widths, and an actuator handle mounted on said axle frame for manipulating both rollers in simultaneous rolling engagement with a paint-receiving surface and to present one roller as a lead roller and the other roller as a drip-catching follower roller.

A further modification of my present invention comprises all of the elements as heretofore mentioned and in assembled relation, together with a latching component for holding the follower roller out of engagement with an overhead paint-receiving surface and in an underlying drip-catching position relative to said lead roller whenever desired.

In accordance with my invention, I provide a specially constructed axle frame which is generally designated by the reference numeral 11 and which is fabricated from a light-weight metal such as aluminum or steel or molded from a plastic material, such as a phenol or urea condensate to define a pair of juxta-posed axles 12 and 13 arranged in parallel relationship as clearly shown in FIG. 2 of the annexed drawings. The frame 11 is formed to a general u-shape to provide a base 14 which carries a short extension 16 fashioned with an enlarged knob 17 thereon, all projecting from the transverse center of base 14 of the frame and formed integral therewith so as to extend parallel with the axles 12 and 13. Associated with axle frame 11 and pivotally mounted on the short extension 16 thereon is and actuator handle 18 which is secured on the distal end of a rod 19 formed with two right angle sections 21 and 22 of which the section 22 carries a loop 23 on its extremity encircling the short extension 16 of the axle frame 11 and which is held against displacement by the knob 17 of the extension. The outer end of the handle 18 is provided with an internally threaded socket 24 for receiving either a hand grip attachment 26 formed in the shape of a T-connection with an externally threaded stem 27 for threaded engagement with the internally threaded socket 24 of actuator handle 18 and also formed with a head 28 which extends laterally on both sides of the threaded stem 27 for facile gripping with the fingers of the hand, as shown in FIG. 8, enabling ready manipulation of the actuator handle 18, or for receiving a long extension rod 29 which may be threaded at its inner end, as at 31, for threaded reception in the threaded socket 24, see FIG. 9.

As particularly illustrated in FIGS. 1 and 2, the improved drip-proof paint roller device of my invention includes a pair of paint rollers 32 and 33 which are rotatably mounted on the axles 12 and 13, respectively, of frame 11 for rolling engagement with a surface and which are covered on their exterior surfaces with the customary wool, felt or other paint-absorbing material from which the paint taken up by the roller is transferred to a surface. The opposite ends of each of the rollers 32 and 33 are supported and closed by a pair of flexible or resilient flanged discs 34 and 35, each having a central opening 36 therein and of which the flange portions 37 project inwardly while portions 39 of their peripheries project outwardly to lend added support for adjacently disposed rollers, as clearly shown in FIGS. 1 and 3, if used, with the openings 36 of the discs fitted into aligned end notches 40 formed in the axles 12 and 13 adjacent to the ends thereof, see FIG. 2. These end supports or discs 34 and 36 are conveniently made of plastic material and because of their flexibility are readily mounted in their aligned notches 40 in the two axles 12 and 13 by enveloping the axles with central openings 36 as they are slated in such notches. As indicated in FIG. 2, a series of aligned notches 41 and 42 are formed in spaced apart relationship from the aligned end notches 40 as well as from one another. The purpose of the series of notches 40, 41 and 42 is to slide the discs along the axles to convert the paint rollers 32 and 33 to different supported widths such as 9 inch rollers, or 7 inch rollers, or as small as 3 inch rollers thereby to accomodate the paint rollers to given paint work to be done, such as close to corners of adjacent walls, or close to wood or metal paneling, or close to doors or door jambs, and thus accomplish with the different widths of rollers, neat and tidy paint jobs. Moreover, different widths of rollers 32 and 33 enable those who are unskilled to wield the paint rollers as efficiently as possible.

In utilizing the paint rollers, roller 32, which is aptly termed the lead roller is dipped into a quantity of desired or suitable paint contained in a conventional paint pan, not shown, and rolled to a somewhat dry state in a dry area of the pan. During this wetting of the lead roller 32, the roller 33, which is aptly termed the follower drip-catching roller, is held above the pan by means of the handle 18. The operator, be it a housewife, husband, or skilled journeyman painter, grasps the handle and moves the two rollers 32 and 33 into engagement with a paint-receiving surface, such as a vertical wall 43 shown in the fragmentary view marked FIG. 4. It is to be noted that the lead roller 32 is disposed above the follower roller 33, and further to be noted that drippings of paint, indicated in FIG. 4 by the reference numeral 44, fall upon and are held on the follower drip-catching roller 33 for spreading rather than falling on the floor. It is also to be observed that the handle 18 is moved through approximately 180° during actuation of the rollers 32 and 33 up and down and from side to side while in pressing engagement with wall 43 and that the follower roller 33 becomes sufficiently wet with paint as to properly smooth out the paint over the wall. Repeated taking up of paint from the paint pan and repeated engagement of the two rollers 32 and 33 enables an operator to complete any given paint job in a much shorter time with less effort because of the light weight of my improved drip-proof roller device.

As illustrated in FIGS. 2, 5 and 6, I provide means for latching the handle 18 in the plane of the axle frame 11 and the follower roller 33 in an underlying drip-catching position in relation to the lead roller 32, when desired. The latching of the roller 33 in an underlying drip-catching position in relation to the lead roller and out of engagement with a paint-receiving surface is effected whenever a surface above the head of the operator, such as a ceiling, indicated at 45 in FIG. 5, is to be painted. This latching means comprises a threaded stud or pin 46 upon which a pair of discs or threaded apertured plates 47 and 48 are moved toward one another from opposite ends of the threaded pin, and thus clamp the axle 13 and a portion of section 22 of handle 18 between the opposed plates 47 and 48 thereby to hold the roller 33 in an underlying drip-catching position relative to the surface engaging roller 32. The clamping action of the two opposed plates or discs 47 and 48 is relieved readily for freeing the roller 33 for movement along a paint-receiving surface, if desired, by merely unscrewing the discs and moving the same apart from one another, and manipulating the handle 18 to bring the roller 33 into rolling engagement with such surface.

It is to be understood that the appended claims are intended to cover the embodiments illustrated as well as other embodiments within the scope and purview of the present invention.

I claim:

1. A drip proof paint roller device comprising a planar axle frame comprising a pair of juxta-posed roller axles arranged in parallel relation, a lead paint roller mounted for rotation on one of said pair of juxta-posed roller axles, a follower roller mounted for rotation on the other of said pair of juxta-posed axles, an actuating handle pivotally mounted on said axle frame for moving both said lead roller and said follower roller in simultaneous rolling engagement with a paint receiving surface, (as well as) and means engaging the frame and handle for locking said handle only in the plane of said axle frame for moving said lead roller about an overhead surface while simultaneously maintaining said follower roller in a drip-catching relation to said lead roller away from said overhead surface.

2. A drip proof paint roller device as set forth in claim 1 wherein said means for latching said follower roller in a drip-catching relation to said lead roller and out of engagement with a paint-receiving surface comprises a threaded pin disposed between a section of said actuating handle and said axle frame, and a pair of plates threadedly engaging opposite ends of said threaded pin and movable thereby into clamping engagement with opposite sides of said section of said actuating handle and said axle frame to prevent relative movement therebetween as well as movable out of engagement therewith to permit relative movement therebetween.

3. A drip proof roller device as set forth in claim 1, and means on each of said juxta-posed roller axles for accomodating rollers of different lengths.

4. A drip proof paint roller device as set forth in claim 3 wherein said means comprises a series of opposed notches arranged in spaced apart alignment on said axles of said axle frame, and a pair of end plates removably mounted in selected notches of said series of opposed notches.

* * * * *